United States Patent [19]

Evans

[11] Patent Number: 4,556,106

[45] Date of Patent: Dec. 3, 1985

[54] GASKETING FOR HEAT EXCHANGER PLATES

[75] Inventor: Geoffrey R. Evans, Crawley, England

[73] Assignee: APV International Limited, England

[21] Appl. No.: 596,516

[22] Filed: Apr. 4, 1984

[30] Foreign Application Priority Data

Apr. 18, 1983 [GB] United Kingdom ..... 8310399
Sep. 2, 1983 [GB] United Kingdom ..... 8323539

[51] Int. Cl.[4] ..... F28F 3/00

[52] U.S. Cl. ..... 165/166; 165/167; 277/181; 277/189

[58] Field of Search ..... 165/166, 167; 277/181, 277/189; 285/325, 339, DIG. 11

[56] References Cited

U.S. PATENT DOCUMENTS

| | | | |
|---|---|---|---|
| 4,002,344 | 1/1977 | Smith | 277/189 X |
| 4,063,591 | 12/1977 | Usher | 165/167 |
| 4,377,204 | 3/1983 | Johansson | 165/166 |
| 4,432,415 | 2/1984 | Wright | 165/167 X |

FOREIGN PATENT DOCUMENTS

| | | | |
|---|---|---|---|
| 62273 | 5/1944 | Denmark | 165/166 |
| 0755265 | 8/1956 | United Kingdom | 165/166 |
| 2028996A | 3/1980 | United Kingdom | 165/167 |
| 2069680A | 8/1981 | United Kingdom | 165/166 |
| 2075656A | 11/1981 | United Kingdom | 165/166 |
| 0416550 | 9/1981 | U.S.S.R. | 165/166 |

*Primary Examiner*—Albert W. Davis, Jr.
*Assistant Examiner*—Randolph A. Smith
*Attorney, Agent, or Firm*—Hamilton, Brook, Smith & Reynolds

[57] ABSTRACT

A gasket retention for heat exchanger plates includes a projection on the gasket which passes through an aperture in the plate with an interference fit. According to the present invention the apertures (2) are made so as to provide two alternative positions for the gasket projections (3), namely a tight position as illustrated in FIG. 1*c* and a freely movable position. The movement between positions may be by twisting as in FIG. 1*c*, or by a longtitudinal movement, e.g. in a key-hole slot aperture. The aperture may be tapered through the plates.

12 Claims, 15 Drawing Figures

GASKETING FOR HEAT EXCHANGER PLATES

BACKGROUND OF THE INVENTION

This invention relates to gasketing for heat exchanger plates.

In United Kingdom patent specifications GB-A 2028996 and GB-A 2075656, there are described various arrangements for avoiding the use of adhesives in securing gaskets to heat exchanger plates. The arrangements all include the idea of projections on the gaskets passing through apertures in the plates with some interference so as to prevent inadvertent removal without making introduction or deliberate removal unduly demanding an operation.

SUMMARY OF THE INVENTION

In accordance with the present invention, it is proposed that the apertures and projections should be so related that in one relative position the projections should pass easily through the aperture and should then be shiftable to a position where their removal is difficult. The latter position is, of course, the normal position of use, but the flexibility of the gasket would permit distortion or shifting to the former position for assembly and possibly removal.

Accordingly, the present invention consists in a heat exchanger plate having a gasket recess and a gasket held in the said recess by interengagement of a series of projections on the gasket and a series of apertures in the plate, in which the projections are movable within the apertures between a first position in which the projections may move freely in and out of the apertures and a second position in which the movement in and out of the apertures is strongly resisted by interference between the projection and the edges of the aperture.

The projections may be moved angularly between the two positions, or alternatively a longitudinal movement may be provided. In either case the elasticity of the gasket material is sufficient to allow some freedom of movement for this purpose. Where the movement between the positions is by twisting, the aperture may for instance be a non-symmetrical heart shape so that one side provides for free movement of the projection, whereas the other provides interference. Alternatively, a slot may be punched at an angle to the normal position of the projection when the gasket is in a position of use, so that the gasket can be manually twisted to allow the projection to pass through the slot and then when in position, the projection will be pressed hard against the edges of the slot and distorted to provide the interference.

Where the movement is longitudinal, the slot may be either tapered along its length or stepped, e.g. with a keyhole slot formation.

The projections may be of parallel-sided section and depend solely upon an interference fit for attachment into the plate apertures. Alternatively, the projections may be provided with a change in section which results in a necked portion which engages with the aperture at the minimum width of the projection to ensure retention.

In any of these arrangements, the apertures in the plate may be tapered in a direction through the plate so as to have a larger dimension on the side of the plate adjacent to the main body of the gasket than on the side to which the projection projects.

This tapering may be smooth or arcuate.

It has been found that the mechanical retention is further enhanced by the provision of the tapered apertures formed in the plate. A tapered aperture provides a guided entry for insertion of the gasket projection and positive engagement when the projection is fitted.

BRIEF DESCRIPTION OF THE DRAWINGS

The invention will be further described with reference to the accompanying drawings which show various forms of the invention, and in which:

FIG. 4 is a similar view showing a modified version of a tapered aperture.

DESCRIPTION OF THE PREFERRED EMBODIMENTS

Figure 1A:
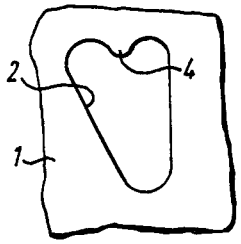
FIG. 1*a* illustrates one form of slot.
Figure 1B:
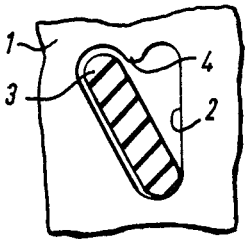
FIG. 1*b* illustrates the slot of FIG. 1*a* with a projection in the free position.
Figure 1C:
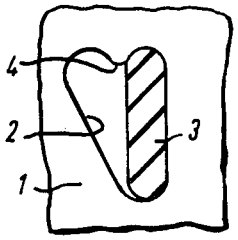
FIG. 1*c* shows the slot of FIG. 1*a* with the projection in the locked position.

Turning first to FIGS. 1*a*, 1*b* and 1*c*, a portion of plate metal is illustrated at 1, and an aperture 2 is shown in the form of an asymmetric heart or cardioid in which one side is distinctly larger than the other. FIG. 1*b* shows a projection 3 on a gasket passing through the larger side of the heart so that free movement in or out of the aperture 2 available. FIG. 1*c* shows the projection 3 pivoted about its lower end and pushed over a protuberance 4 into a locked or tight position in the smaller half of the heart shaped aperture 2. When it is desired to remove the gasket, it may be possible to twist the projection into the free position. Alternatively it can be cut off to free the gasket for removal.

Figure 2A:
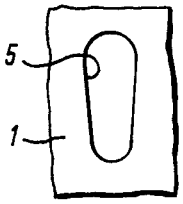
FIGS. 2*a*, 2*b*, 2*c*.
Figure 2B:
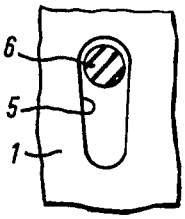
Figure 2C:
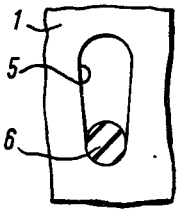

FIGS. 2*a*, 2*b* and 2*c* show the plate 1 having an aperture in the form of a tapered slot 5. In this case, the projection 6 is of circular section and is introduced into the larger end of the slot 5. After introduction, the gasket is slid along so that the projection 6 enters the smaller end of the slot 5 and is wedged and disorted into a tight and positively locked position.

Again, removal may either be by the reverse movement or by cutting off the projection 6.

Figure 3A:
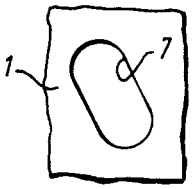
FIGS. 3*a*, 3*b*, 3*c*.
Figure 3B:
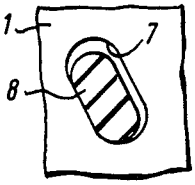
Figure 3C:
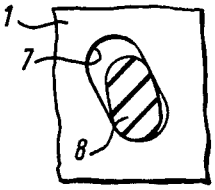

In the arrangement of FIGS. 3*a*, 3*b* and 3*c*, the plate 1 has a punched slot 7 set obliquely to the in use position of the projection 8, so that the projection 8 can be introduced in the twisted position of FIG. 3*b* and on release will move to the position of FIG. 3*c*, in which it is somewhat distorted and wedged against the sides of the slot 7.

Removal may again be by reverse twisting or removal of the projection.

Figure 4A:
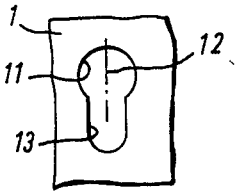
FIGS. 4*a*, 4*b*, and 4*c* are all views similar respectively to FIGS. 1*a*, 1*b* and 1*c* showing different forms of arrangements in accordance with the invention.
Figure 4B:
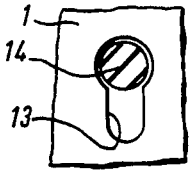
Figure 4C:
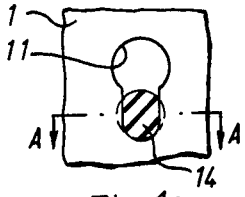
Figure 4D:
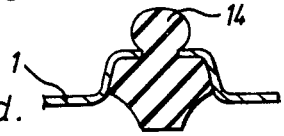
FIG. 4*d* is a section on the line A—A of FIG. 4*c*.

FIGS. 4*a* to 4*d* show an arrangement in which the plate 1 is formed with a key-hole slot 11 having a larger end 12 and a smaller end 13. The circular section projection 14 is introduced via the larger end 12 as shown in FIG. 4*b* and subsequently shifted longitudinally in translation to the position of 4*c* in which the projection 14 is forced into the smaller end 13 of the key-hole slot 11 and positively engaged by a neck, as illustrated in FIG. 4*d*.

The application of a necked projection may likewise be employed for any of the preceding embodiments.

Again, the projections may be cut off or removed by reverse sliding to free them from the apertures.

It is envisaged that in all cases removal of a gasket may be started by cutting off one or two projections in order to release part of the length of the gasket and the remaining part may then have sufficient freedom of movement to be twisted or moved longitudinally of the gasket recess to free the projections from their corresponding apertures.

Figure 5:
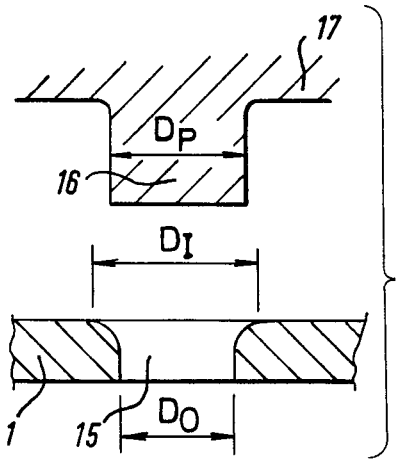
FIG. 5 is an exploded view of the gasket projection about to enter an aperture tapered through the plate in a preferred arrangement according to the invention.
Figure 6:
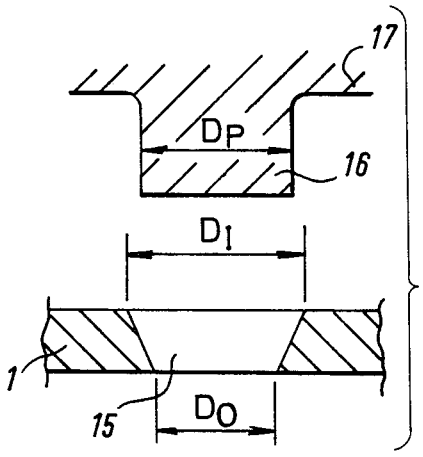

Turning now to FIGS. 5 and 6, these show sections of typical tapered apertures 15 formed in a plate 1 for co-operation with a projection 16 provided on a gasket 17. As illustrated in FIG. 5, the aperture 15 is provided with arcuate tapering from a maximum inlet diameter Di to a minimum outlet diameter Do. The arrangement is such that the projection diameter Dp lies between the values Di and Do.

In the arrangement of FIG. 2, the tapering from the maximum diameter Di to the minimum diameter Do is shown as being smooth.

Since the minimum diameter Do is somewhat smaller than the effective diameter Dp of the projection, it provides an interference fit to ensure mechanical retention.

The tapered sides of the aperture section may be equally applied to any form or shape of slot or aperture in the plate.

Various other modifications may be made within the scope of the invention.

I claim:

1. In a heat exchanger plate assembly comprising a plate having a gasket recess and a gasket held in the said recess by interengagement of a series of projections on the gasket and a series of apertures in the plate: the improvement that the projections are movable within the apertures between a first position, in which the projections may move freely in and out of the apertures, and a second position, in which the movement in and out of the apertures is strongly resisted by interference between the projection and the aperture.

2. A plate assembly as claimed in claim 1, in which the projections are movable angularly between said first position and said second position.

3. A plate assembly as claimed in claim 2, in which the projections are elongated and the apertures are generally heart shaped, with one side of the heart larger than the other, so that the elongate projection will be a tight fit in one side of the aperture but will be freely movable through the other side thereof.

4. A plate assembly as claimed in claim 1, in which the projections are movable in translation between said first position and said second position.

5. A plate assembly as claimed in claim 1, in which the apertures are slots tapered along their lengths.

6. A plate assembly as claimed in claim 1, in which the slots are of key-hole configuration.

7. A plate assembly as claimed in claim 1, in which the projections have a necked change in section, and movement in and out of the apertures is strongly resisted by engagement at the minimum section of the projection.

8. A plate assembly as claimed in claim 1, in which the apertures are tapered through the plate so as to have a larger dimension on the side of the plate adjacent to the main body of the gasket than on the side to which the projection projects.

9. A plate assembly as claimed in claim 8, in which the tapering is smooth.

10. A plate assembly as claimed in claim 8, in which the tapering is arcuate.

11. A plate assembly as claimed in claim 5 wherein the apertures are tapered through the plate so as to have a larger dimension on the side of the plate adjacent to the main body of the gasket then on the side to which the projection projects.

12. A plate assembly as claimed in claim 11 in which the tapering is arcuate.

* * * * *